US005712951A

United States Patent [19]

Chou

[11] Patent Number: 5,712,951

[45] Date of Patent: Jan. 27, 1998

[54] ELECTRIC WATER HEATER WITH PRIMARY AND SECONDARY PRE-HEATNG CHAMBERS

[76] Inventor: Martin Chou, 3F, No. 2, Sec.5, Cheng-Teh Road,, Hou-Kang, Shih-Lin District, Taipei, Taiwan

[21] Appl. No.: 547,356

[22] Filed: Oct. 24, 1995

[51] Int. Cl.[6] ..... F24H 1/18

[52] U.S. Cl. ..... 392/450; 392/452; 392/454; 165/172; 126/362

[58] Field of Search ..... 392/341, 441, 392/450, 451, 452, 454, 456, 485, 486, 490, 491; 165/155, 172, 173, 174, 175, 176; 126/362

[56] References Cited

U.S. PATENT DOCUMENTS

| | | | |
|---|---|---|---|
| 3,960,207 | 6/1976 | Boer | 392/341 |
| 4,514,617 | 4/1985 | Amit | 392/485 |
| 4,835,365 | 5/1989 | Etheridge | 392/491 |
| 5,149,399 | 9/1992 | Kishi et al. | 392/451 |

*Primary Examiner*—Tu B. Hoang

*Attorney, Agent, or Firm*—Morton J. Rosenberg; David I. Klein; Jun Y. Lee

[57] ABSTRACT

An electric water heater including a control unit, and a heating unit having a water container and an electric heating coil inside the water container and being controlled by a control unit, wherein a perforated heat-conductive cylinder is mounted inside the water container around the electric heating coil to separate the inside space of the water container into a heating chamber on the inside and a pre-heating chamber on the outside; a perforated heat-conductive collar is mounted around the cylinder to separate the pre-heating chamber into a primary pre-heating chamber at the bottom and a secondary pre-heating chamber at the top; the solid-state variable resistor of the control unit has a heat sink attached to a water accumulation chamber of the cold water pipe which guides cold water to the primary pre-heating chamber, which heat sink transmitting heat from the solid-state variable resistor to cold water in the water accumulation chamber.

9 Claims, 6 Drawing Sheets

ELECTRIC WATER HEATER WITH PRIMARY AND SECONDARY PRE-HEATNG CHAMBERS

BACKGROUND OF THE INVENTION

The present invention relates to electric water heaters, and relates more particularly to an electric water heater which separates the water container into an outer pre-heating chamber and an inner heating chamber for permitting intake cold water to be pre-heated in the pre-heating chamber before entering the heating chamber.

Conventional electric water heaters commonly comprise a water container having a cold water inlet and a hot water outlet, and an electric heating coil mounted in the heating chamber defined inside the water container and controlled to heat cold water to a pre-determined temperature. Because cold water is directly heated by the electric heating coil in the heating chamber of the water container, a long heating time is needed to heat cold water to the desired temperature. Furthermore, because cold water is continuously guided into the heating chamber during the operation of the electric heating coil, the heating efficiency of the electric water heater is affected.

SUMMARY OF THE INVENTION

The present invention has been accomplished to provide an electric water heater which eliminates the aforesaid drawbacks by dividing the inside space of the water container into a heating chamber and a pre-heating chamber, permitting cold water to be pre-heated in the pre-heating chamber before it is guided into the heating chamber.

According to one aspect of the present invention, the electric water heater comprises a control unit, and a heating unit having a water container and an electric heating coil inside the water container and being controlled by the control unit, the heating unit comprising an insulative water container having a cold water inlet pipe and a hot water outlet pipe, and an electric heating coil mounted inside the water container and controlled by the control unit to heat water, the control unit comprising a non-fuse safety switch, a solid-state variable resistor, a temperature regulating switch, wherein a heat-conductive cylinder is mounted inside the water container around the electric heating coil, defining a heating chamber on the inside connected to the hot water outlet pipe and a pre-heating chamber on the outside connected to the cold water inlet pipe, the heat-conductive cylinder having a plurality of small holes for letting cold water pass from the pre-heating chamber to the heating chamber; a heat-conductive partition collar is mounted between the insulative water container and the heat-conductive cylinder to separate the pre-heating chamber into a primary pre-heating chamber at a lower elevation and a secondary pre-heating chamber at a higher elevation, the primary pre-heating chamber receiving cold water from the cold water inlet, the heat-conductive partition collar having a plurality of small holes for letting cold water pass from the primary pre-heating chamber to the secondary pre-heating chamber and then to the heating chamber through the small holes of the heat-conductive cylinder. According to another aspect of the present invention, the cold water inlet pipe comprises a water accumulation chamber for accumulation of cold water; the solid-state variable resistor of the control unit has a heat sink at a back side thereof closely attached to the water accumulation chamber of the cold water inlet pipe for transmitting heat from the solid-state variable resistor to cold water in the water accumulation chamber.

DETAILED DESCRIPTION OF THE PREFERRED EMBODIMENT

Figure 1:
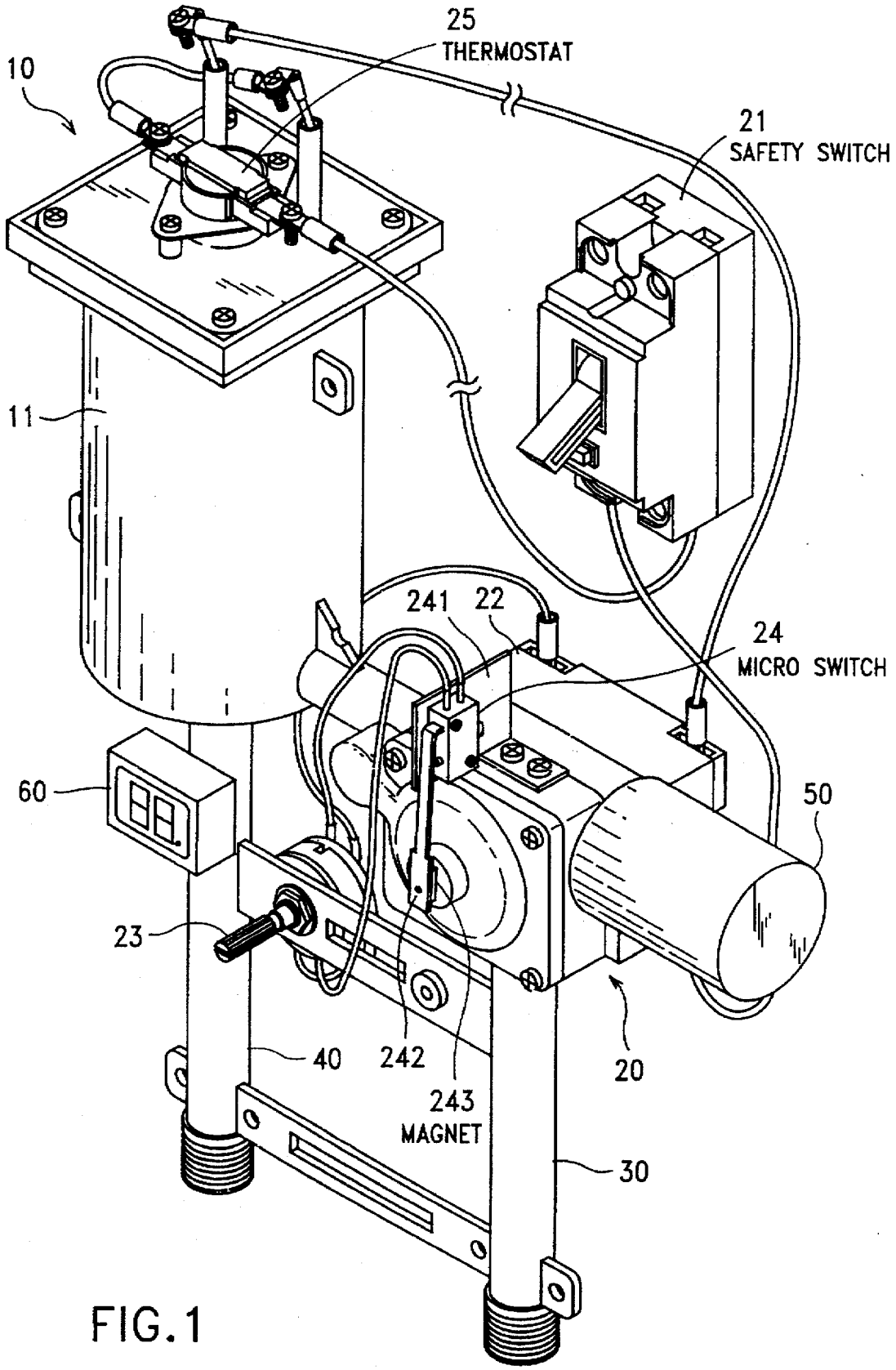
FIG. 1 is an elevational view of an electric water heater according to the present invention.

Referring to FIG. 1, an electric water heater in accordance with the present invention is generally comprised of a heating unit 10 and a control unit 20. The control unit 20 comprises a non-fuse safety switch 21, a solid-state variable resistor 22, and a stepless fine-adjustment switch 23.

Figure 2:
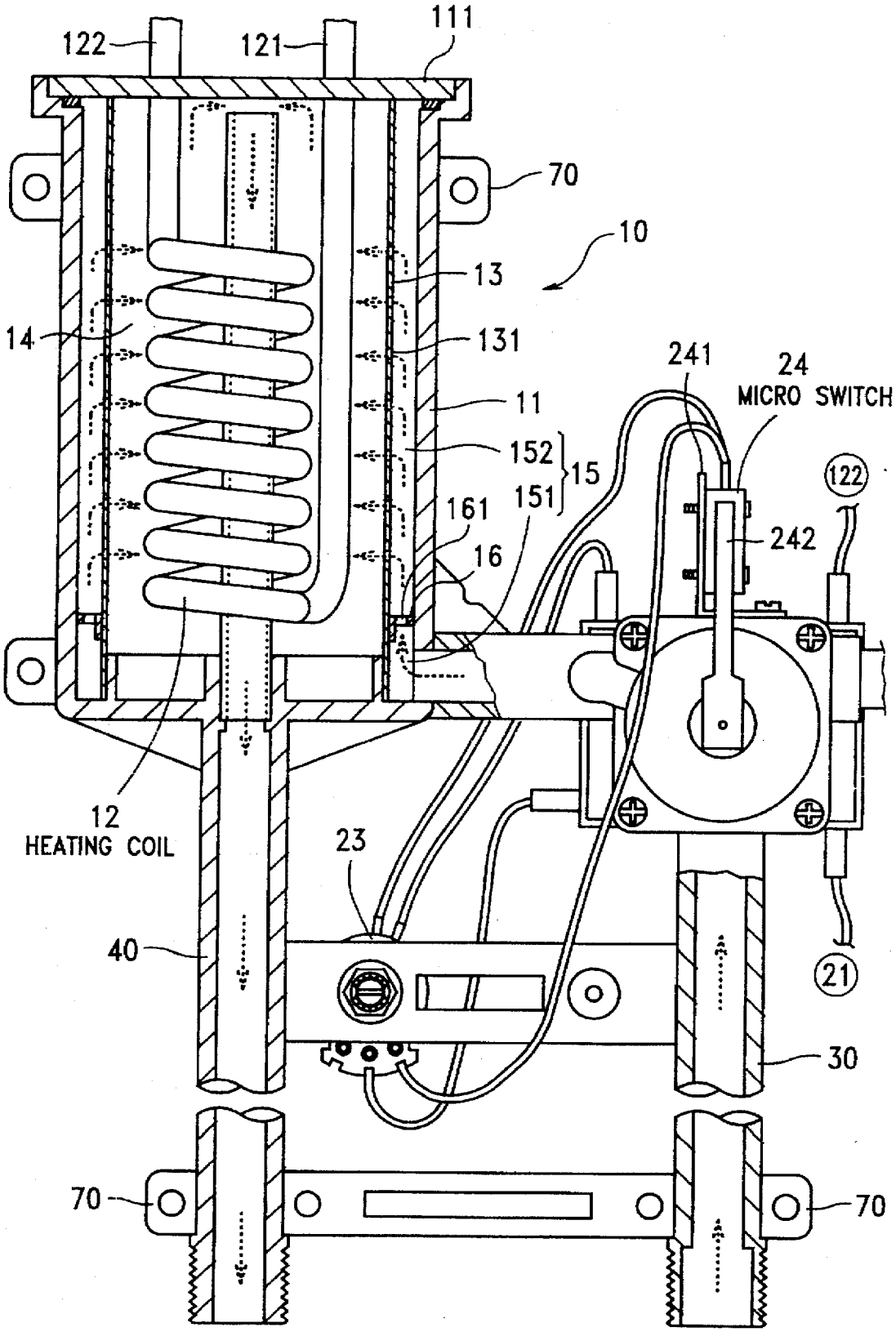
FIG. 2 is a sectional elevation of the electric water heater shown in FIG. 1.
Figure 3:
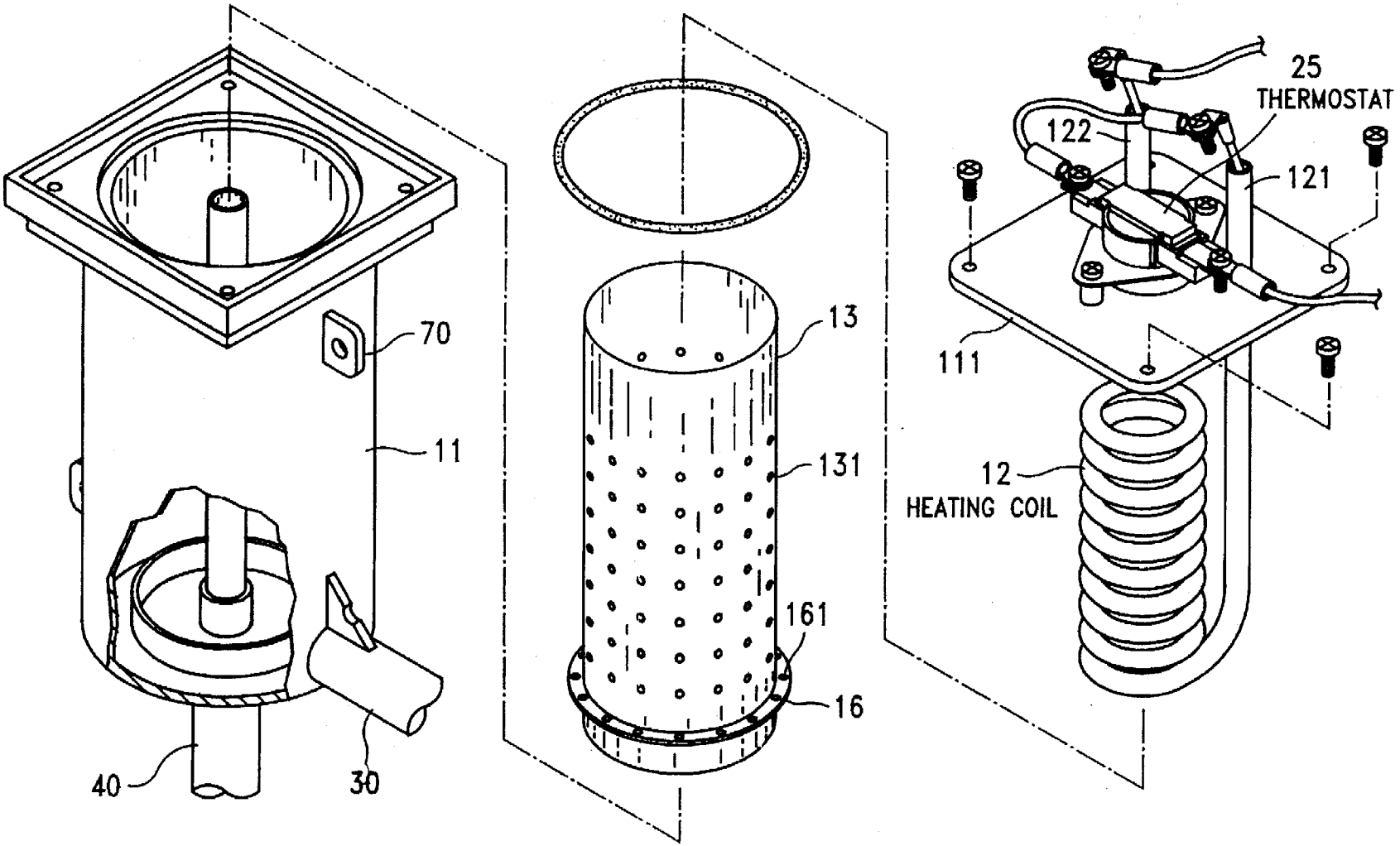
FIG. 3 is an exploded view of the heating unit of the electric water heater shown in FIG. 1.

Referring to FIGS. 2 and 3, and FIG. 1 again, the heating unit 10 comprises an insulative water container 11, an electric heating coil 12 mounted inside the water container 11, and a heat-conductive cylinder 13 disposed inside the water container 11 around the electric heating coil 12. The insulative water container 11 is covered with a top cover 111, having a water inlet pipe 30 for guiding cold water into the water container 11, a water outlet pipe 40 for guiding hot water out of the water container 11. A plurality of mounting lugs 70 are made on the water container 11, the water inlet pipe 30, and the water outlet pipe 40 for mounting. Through the mounting lugs 70, the heating unit 10 can be fastened to a wall support or the like. The two opposite ends 121 and 122 of the heating coil 12 extend out of the top cover 111 and connected to a non-fuse safety switch 21 through a thermostat 25. The heat-conductive cylinder 13 is preferably made from red bronze, having a plurality of small holes 131 over the periphery. A heating chamber 14 is defined within the heat-conductive cylinder 13. The heating chamber 14 is connected to the water outlet pipe 40. A pre-heating chamber 15 is defined outside the heat-conductive cylinder 13 within the insulative water container 11. A heat-conductive partition collar 16 is mounted between the heat-conductive cylinder 13 and the water container 11 to separate the pre-heating a chamber 15 into a primary pre-heating chamber 151 and a secondary pre-heating chamber 152. The primary pre-heating chamber 151 is connected to the water inlet pipe 30. The partition collar 16 has a plurality of small holes 161 for guiding cold water from the primary pre-heating chamber 151 to the secondary pre-heating chamber 152.

Figure 4:
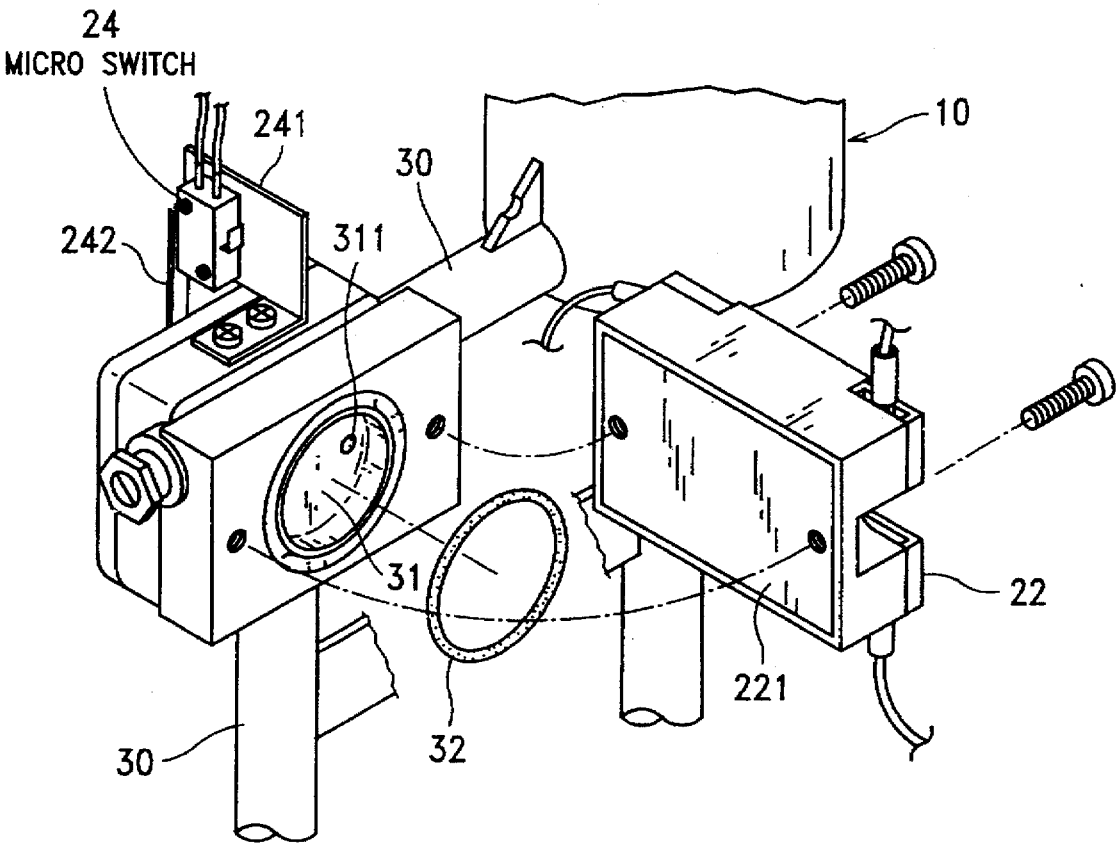
FIG. 4 is a dismantled view of the solid-state variable resistor according to the present invention.
Figure 5:
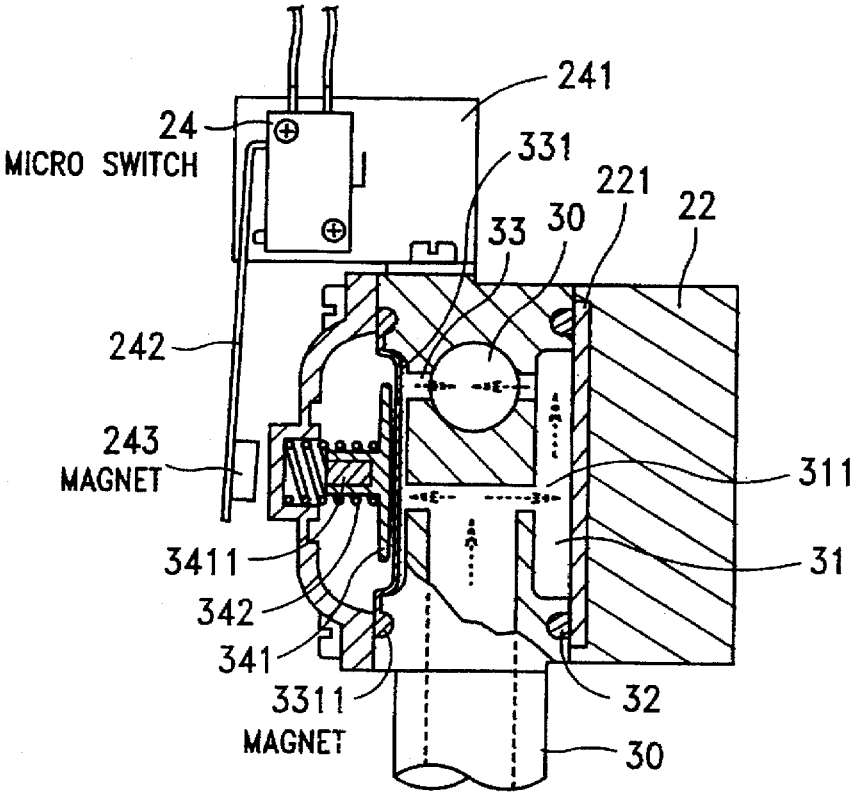
FIG. 5 is a sectional view showing the position of the actuating diaphragm relative to the water accumulation chamber and the solid-state variable resistor, and the position of the push rod relative to the actuating diaphragm and the micro-switch according to the present invention.
Figure 5A:
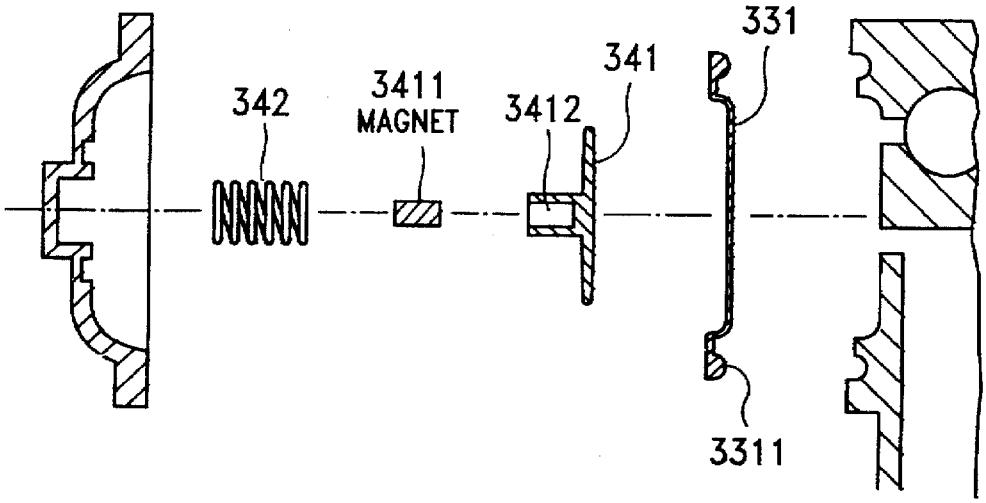
FIG. 5A is an exploded view of the water pressure balance chamber shown in FIG. 5.

Referring to FIGS. 4, 5 and 5A the water inlet pipe 30 comprises a water accumulation chamber 31. Cold water is guided from the water inlet pipe 30 to the water accumulation chamber 31 through a first water passage 311, then returned to the water inlet pipe 30 through a second water passage 33. The solid-state variable resistor 22 has a heat sink 221 at the back side fixedly secured to the water accumulation chamber 31 and sealed by a water seal ring 32. When the solid-state variable resistor 22 works, it produce heat, and heat from the solid-state variable resistor 22 is transmitted through the heat sink 221 to cold water in the water accumulation chamber 31. An actuating diaphragm 331 having a water sealing ring 3311 formed at an outer edge thereof is mounted in one side of the water accumulation chamber 31 opposite to the solid-state variable resistor 22 and sealed by the water seal ring 3311. A water pressure balance chamber 34 is defined at one side of the actuating diaphragm 331 opposite to the water accumulation chamber 31. A T-shape push rod 341 is mounted inside the water pressure balance chamber 34. A spring 342 is mounted inside the water pressure balance chamber 34 to force the T-shape push rod 341 against the actuating diaphragm 331. The T-shape push rod 341 has a hole 3412 in the axle direction. A magnet 3411 is fixed in the hole 3412 of the T-shape push rod 341. A micro-switch 24 is disposed on top of the control unit 20 by a fixing plate 241. A control lever 242 extending from the micro-switch 24 is adjacent to the T-shape push rod 341. A magnet 243 is fixed on the end of the control lever 242 of the micro-switch 24 to be in turn with the magnet 3411 of the T-shape push rod 341. When cold water passes through the water accumulation chamber 31 and the second water passage 33 and flows to the primary pre-heating chamber 151 through the water inlet pipe 30, the actuating diaphragm 331 is forced outwards by water pressure to compress the spring 342 and to force the T-shape push rod 341 near the control lever 242 of the micro-switch 24. And the magnetic attraction of two magnets 3411, 243 causing the control lever 242 of the micro-switch 24 near the T-shape push rod 341 and turn on the control unit 20. When the control unit 20 is turned on, the heating system which is formed of the solid-state variable resistor 22, the stepless fine-adjustment switch 23 and the electric heating coil 12, is operated to heat cold water. When the supply of cold water is stopped, the spring 342 immediately forces the T-shape push rod 341 away from the control lever 242 of the micro-switch 24, causing the micro-switch 24 to cut off power supply from the control unit 20, and therefore the heating system is stopped.

Referring to FIGS. 1 and 2 again, when cold water is guided into the primary pre-heating chamber 151 from the water inlet pipe 30, it is pre-heated by heat which is transmitted from the electric heating coil 12 to the heat-conductive cylinder 13 and the heat-conductive partition collar 16. Primarily pre-heated water flows through the small holes 161 of the heat-conductive partition collar 16 to the secondary pre-heating chamber 152 at which it is pre-heated again, then flows from the secondary pre-heating chamber 152 through the small holes 131 of the heat-conductive cylinder 13 into the heating chamber 14 for heating into hot water by the electric heating coil 12 directly. Hot water is then guided out of the insulative water container 11 through the water outlet pipe 40. The temperature of hot water can be preset by the stepless fine-adjustment switch 23 which operates the solid-state variable resistor 22 to supply an adequate electric current to the heating coil 12 for controling an adequate electric current to the heating coil 12 for controling the water temperature to a predetermined degree therefore.

Figure 6:
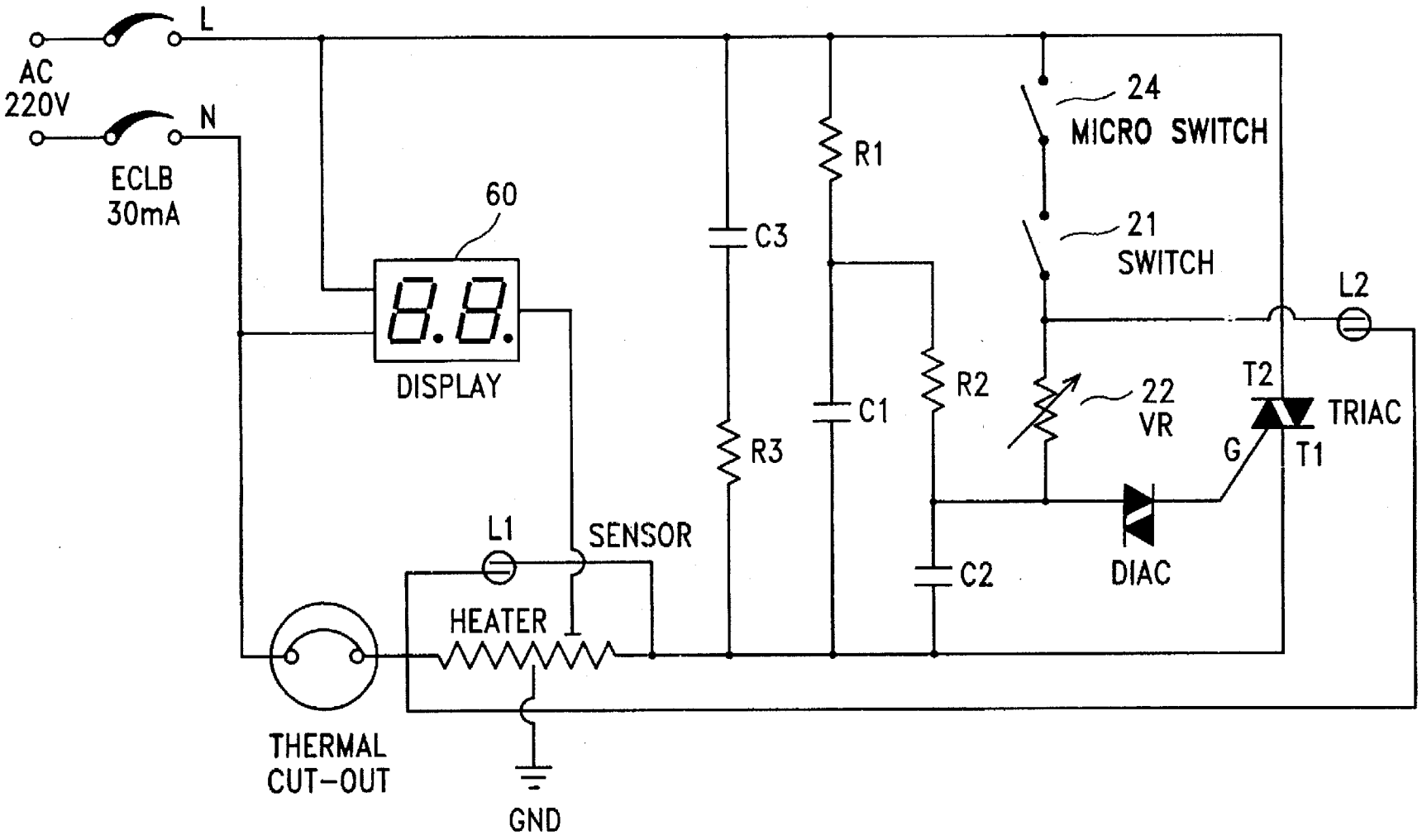
FIG. 6 is a circuit diagram of the solid-state variable resistor according to the present invention.

Referring to FIG. 6, the non-fuse safety switch 21 automatically cuts off power supply from the control unit 20 upon an overcurrent or an electric leakage.

Referring to FIG. 1 again, a conventional pressure relief valve 50 is installed in the water inlet pipe 30 to automatically release pressure from the heating unit 10 when the pressure of the heating unit 10 surpasses a predetermined value; a conventional temperature display 60 is installed in the water outlet pipe 40 to automatically shows the temperature of hot water passing through the water outlet pipe 40. The aforesaid thermostat 25 is mounted on the top cover 111 of the water container 11. The top cover 111 is made of heat-conductive material, for example, bronze.

It is to be understood that the drawings are designed for purposes of illustration only, and are not intended as a definition of the limits and scope of the invention disclosed.

I claim:

1. An electric water heater with primary and secondary pre-heating chambers comprising a heating unit and a control unit, said heating unit comprising an insulative water container having a cold water inlet pipe and a hot water outlet pipe, and an electric heating coil mounted inside said water container and controlled by said control unit to heat water, said control unit comprising a non-fuse safety switch for protecting the water heater from an overcurrent or a leakage current, a solid-state variable resistor operated by a stepless fine-adjustment switch for controling a preset water temperature therefor, wherein a heat-conductive cylinder is mounted inside said insulative water container around said electric heating coil, defining a heating chamber on the inside connected to said hot water outlet pipe and a pre-heating chamber on the outside within said water container, said heat-conductive cylinder having a plurality of small holes for letting water pass from said pre-heating chamber to said heating chamber; a heat-conductive partition collar is mounted between said insulative water container and said heat-conductive cylinder to separate said pre-heating chamber into a primary pre-heating chamber at a lower elevation and a secondary pre-heating chamber at a higher elevation, said primary pre-heating chamber receiving cold water from said cold water inlet, said heat-conductive partition collar having a plurality of small holes for letting water pass from said primary pre-heating chamber to said secondary pre-heating chamber and then to said heating chamber through the small holes of said heat-conductive cylinder; a water-pressure activated switch means installed in said cold water inlet pipe to automatically turn on said control unit when cold water is guided through said cold water inlet pipe into said insulative water container, or to automatically turn off said control unit when cold water is stopped from passing through said cold water inlet pipe.

2. The electric water heater with primary and secondary pre-heating chambers of claim 1 wherein said cold water inlet pipe comprises a water accumulation chamber for accumulation of cold water; said solid-state variable resistor has a heat sink at a back side thereof closely attached to the water accumulation chamber of said cold water inlet pipe for transmitting heat from said solid-state variable resistor to cold water in said water accumulation chamber.

3. The electric water heater with primary and secondary pre-heating chambers of claim 1 wherein a connection area between said heat sink of said solid-state variable resistor and said water accumulation chamber of said cold water inlet pipe is sealed by a water seal ring.

4. The electric water heater with primary and secondary pre-heating chambers of claim 1 further comprising a pressure relief valve installed in said cold water inlet pipe for releasing excessive pressure from said heating unit.

5. The electric water heater with primary and secondary pre-heating chambers of claim 1 wherein said temperature regulating switch is a stepless fine-adjustment switch.

6. The electric water heater with primary and secondary pre-heating chambers of claim 1 further comprising a temperature display installed in said hot water outlet pipe to automatically indicate the temperature of hot water passing through said hot water outlet pipe.

7. The electric water heater with primary and secondary pre-heating chambers of claim 1 wherein said heat-conductive cylinder is preferably made from red bronze.

8. The electric water heater with primary and secondary pre-heating chambers of claim 1 wherein said insulative water container has at least one mounting lug for hanging.

9. The electric water heater with primary and secondary pre-heating chambers of claim 1 wherein said water-pressure activated switch comprises a micro-switch and a water pressure balance chamber, said water pressure balance chamber separating said water accumulation chamber from an actuating diaphragm said actuating diaphragm having a sealing ring formed at an outer edge fixed between said two adjacent chambers therein said water pressure balance chamber comprising a T-shape push rod mounted inside said water pressure balance chamber and having a hole in an axle direction of said T-shape push rod, a spring mounted inside said water pressure balance chamber to force said T-shape push rod against said actuating diaphragm, and a magnet fixing in said hole of said T-shape push rod, said micro-switch mounted on top of said control unit by a fixing plate comprising a control lever extended from said micro-switch, and a magnet mounted on end of said control lever being in turn with said magnet of said T-shape push rod.

* * * * *